US006274022B1

(12) United States Patent
Asai et al.

(10) Patent No.: US 6,274,022 B1
(45) Date of Patent: Aug. 14, 2001

(54) METHOD FOR PRODUCING ELECTRO- OR ELECTROLESS-DEPOSITED FILM WITH A CONTROLLED CRYSTAL ORIENTATION

(75) Inventors: Shigeo Asai, Nagoya; Kensuke Sassa, Aichi-Gun; Takahisa Taniguchi, Ichinomiya, all of (JP)

(73) Assignee: Nagoya University, Nagoya (JP)

( * ) Notice: Subject to any disclaimer, the term of this patent is extended or adjusted under 35 U.S.C. 154(b) by 0 days.

(21) Appl. No.: 09/387,612

(22) Filed: Aug. 31, 1999

(30) Foreign Application Priority Data

Feb. 19, 1999 (JP) ..... 11-040804

(51) Int. Cl.[7] ..... C25D 5/00

(52) U.S. Cl. ..... 205/89; 205/148; 427/304; 427/443.1; 427/598

(58) Field of Search ..... 205/89, 90, 148; 427/98, 304, 305, 443.1, 598

(56) References Cited

U.S. PATENT DOCUMENTS 4,244,788 * 1/1981 Faulkner ..... 360/133

5,372,698 * 12/1994 Liao ..... 205/90

FOREIGN PATENT DOCUMENTS 59-104495 6/1984 (JP) .
7-41996 2/1995 (JP) .

* cited by examiner

*Primary Examiner*—Kathryn Gorgos
*Assistant Examiner*—William Leader
(74) *Attorney, Agent, or Firm*—Burr & Brown

(57) ABSTRACT

A method for producing electro- or electroless-deposited-film, in which the crystal orientation of the film is controlled to provide improved product properties. A paramagnetic material or diamagnetic material in its electrolytic-state is deposited on a substrate by an electro- or electroless-deposition process. A magnetic field having an intensity at least on the order of 7 T is applied in a predetermined direction, so as to perform the deposition in environment added with the magnetic field. A porous plate is preferably arranged adjacent to the substrate, for suppressing flow of an electrolytic liquid that may occur during the application of the magnetic field.

5 Claims, 4 Drawing Sheets

METHOD FOR PRODUCING ELECTRO- OR ELECTROLESS-DEPOSITED FILM WITH A CONTROLLED CRYSTAL ORIENTATION

BACKGROUND OF THE INVENTION

1. Field of the Invention

This invention relates to a method of producing electro- or electroless-deposited film with a controlled crystal orientation and, in particular, to a method for controlling the crystal orientation in order to provide improved product properties.

2. Description of Related Art

A thin film is conventionally deposited and developed on a substrate by various deposition method, including a wet method such as electro- or electroless-deposition method, and a dry method such as sputtering method, PVD method, CVD method and the like. Among other things, in the wet method, a material (e.g., metal) in electrolytic solution assumes an ionic state and is deposed on a substrate to form a thin film by electro-deposition method or electroless-deposition method. In this instance, it is desirable to control the crystal orientation of the deposited film to improve the product property of the film. The crystal orientation of the deposited film is generally controlled by:

(1) orienting crystals of the deposited film into conformity with the crystal orientation of the substrate, or (2) subjecting the deposited film to stresses through the substrate, (3) controlling an overvoltage applied to the electro-deposition environment.

The method (1) above is generally known as epitaxial method, and requires no particular explanations. The method (2) above is usually seen when stresses are added to the substrate during the deposition process due to a difference in terms of the coefficient of thermal expansion between the substrate and the deposited film. Furthermore, the method (3) above utilizes a phenomenon wherein an easy axis of the crystals in the deposited material, in which electro-deposition tends to readily occur, changes depending upon the applied overvoltage. For example, in the case of an electro-deposited Zn film, the crystals of the deposited Zn film are oriented into the c-axis when the overvoltage is low, and into the a-axis or b-axis under an increased overvoltage.

Beside the above-mentioned methods (1), (2) and (3), there may be instances wherein the crystal orientation of the deposited film is controlled by controlling temperature of the substrate or the temperature or flow of the electrolytic solution, etc.

However, these methods suffer from a serious problem that they can be applied only to specific substances. Moreover, while the known method for developing the deposited film allows the development of a deposited film comprising crystals oriented in a thermodynamically stable direction, it is still difficult, if not impossible, to develop a deposited film comprising crystals which are oriented in other direction.

SUMMARY OF THE INVENTION

It is therefore an object of the present invention to provide a method of producing electro- or electroless-deposited film with a controlled crystal orientation, which can be widely applied without being limited to specific materials or to specific crystal orientation of the deposited film.

In general, a substance has magnetism and is classified into magnetic material and non-magnetic material. The magnetic material refers to ferromagnetic body, while the non-magnetic material refers to paramagnetic body or diamagnetic body. Moreover, a crystal of the substance has different magnetic susceptibility according to the crystal orientation. Therefore, when the material having different magnetic susceptibility according to the crystal orientation is electro- or electroless-deposited on a substrate while applying a magnetic field, the deposited crystals of the material on the substrate are oriented so that the direction of the crystal orientation having a higher magnetic susceptibility is in parallel with the direction in which the magnetic field is applied. Such a phenomenon is utilized in the present invention.

According to the invention, a material to be electro- or electroless-deposited is made to have an ionic state in a conventional manner and is then aggregated, electro-deposited or electroless-deposited on a substrate. A magnetic field is applied to the electro-deposition or electroless-deposition environment, i.e., an environment which surrounds the substrate and the material in electrolytic state.

Since the crystals of the substance have magnetic anisotropy, when the substance is electro- or electroless-deposited while being applied with a magnetic field, the crystals of the deposited substance are oriented on the substrate, with the crystal orientation having a higher magnetic susceptibility being in parallel with the direction in which the magnetic field is applied. Therefore, by applying the magnetic field so that the crystals of the deposited substance on the substrate are oriented to have the desired crystal orientation according to the invention, it is possible to obtain a deposition film having a desired crystal orientation.

In the method according to the present invention, it is preferred that a porous plate is arranged adjacent to the substrate so as to suppress a flow of an electrolytic solution which occurs during the application of the magnetic field. Such a porous plate serves to improve the property of the crystal orientation, since the flow of the electrolytic solution is suppressed by the porous plate during the electro- or electroless-deposition.

The material to be subjected to the electro- or electroless-deposition may be a paramagnetic material or diamagnetic material. Even such materials can be formed into a thin film having a desired crystal orientation, by adequately controlling the direction of the magnetic field. This is because a magnetic anisotropy is inherent not only to a ferromagnetic body, but also to a paramagnetic body or a diamagnetic body. In this instance, it is preferred that the magnetic field has an intensity which is at least on the order of 7 T, preferably on the order of 10 T.

DETAILED DESCRIPTION OF THE PREFERRED EMBODIMENT

Figure 1A:
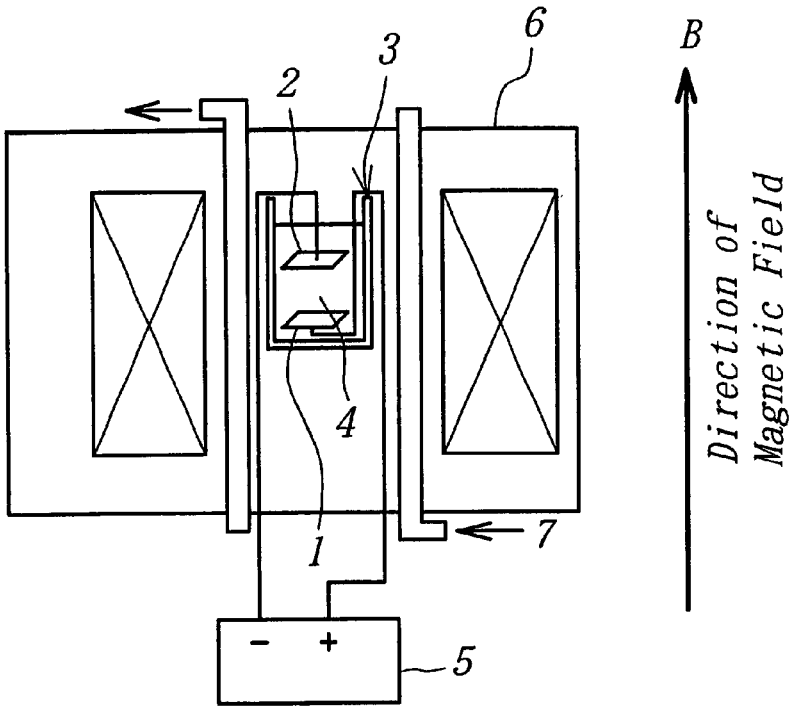
FIG. 1*a* and FIG. 1*b* are schematic views showing a typical arrangement of an electro-deposition apparatus which can be suitably used for carrying out the method according to the invention.

The present invention will be explained below in further detail, with reference to some specific embodiments shown in the drawings.

Figure 1B:
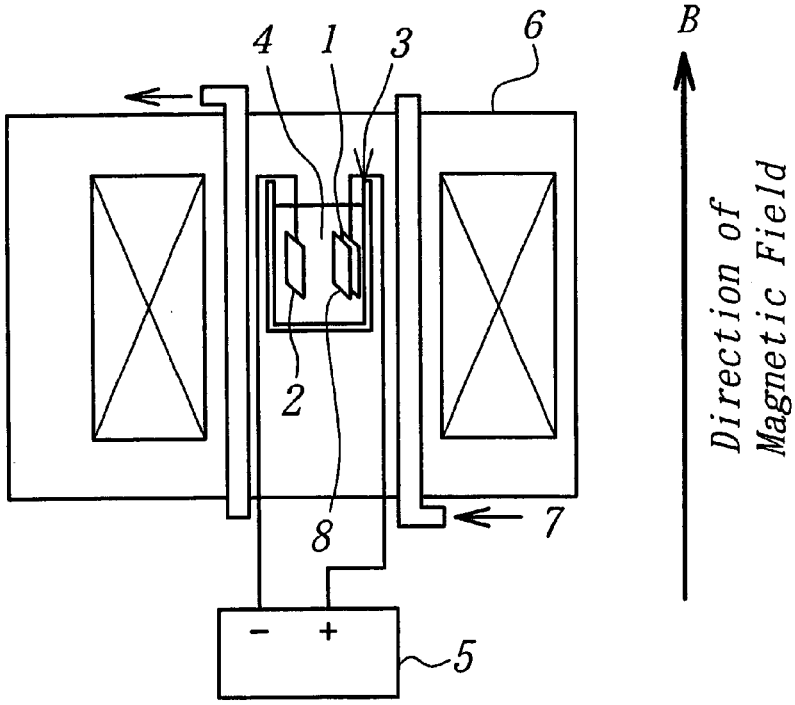

There is shown in FIG. 1*a* and FIG. 1*b* a typical arrangement of an electro-deposition apparatus which can be suitably used to carry out the method according to the invention. As shown in these figures, a substrate 1 and a metal 2 for electro-deposition are accommodated within an electro-deposition casing 3 which is filled with an electrolytic solution of the metal 4. The apparatus further includes an electric power supply unit 5, a magnet 6 which surrounds the deposition casing 3. The magnet 6 is cooled and thereby protected by a coolant 7. The magnet 6 may comprise a superconductive magnet. As further shown in FIG. 1*b*, a flow-suppression porous plate 8 may be arranged adjacent to the substrate 1.

As shown in FIG. 1*a* and FIG. 1*b*, according to the invention, the electro-deposition of the metal 2 on the substrate 1 is carried out after the metal 2 has been ionized within the casing 3 filled with the electrolytic solution 4, by supplying an electric current from the power supply unit 6. The electro-deposition is typically carried while being applied with a predetermined overvoltage and under a specific composition of the electrolytic solution 4.

According to the present invention, a magnetic field is applied in a predetermined direction so that the electro- or electroless-deposition is performed in an environment that is added with the magnetic field. In this instance, the magnetic field may be applied in a direction which is perpendicular to the surface of the metal 2 (FIG. 1*a*), or in a direction which is parallel with the surface of the metal 2 (FIG. 1*b*).

When the electro-deposition is carried out under the application of a magnetic field, according to the invention, the direction of the metallic crystals can be controlled by the magnetic field, thereby allowing development of a film on the substrate, of which the crystal orientation is aligned with the direction in which the magnetic field is applied. It is therefore possible to produce functional materials having excellent properties, e.g., thermoelectric conversion efficiency, resistance to corrosion or abrasion, etc.

The intensity of the magnetic field to be applied during the electro- or electroless-deposition is adjusted according to the magnetic property of the ionized substance. For many substances, the magnetic field of not less than about 5 T is sufficient, though it is preferred in the case of a substance having especially paramagnetic properties to apply the magnetic field of not less than 7 T, more preferably, not less than 10 T in order to control the crystal orientation in a satisfactory manner.

Figure 2A:
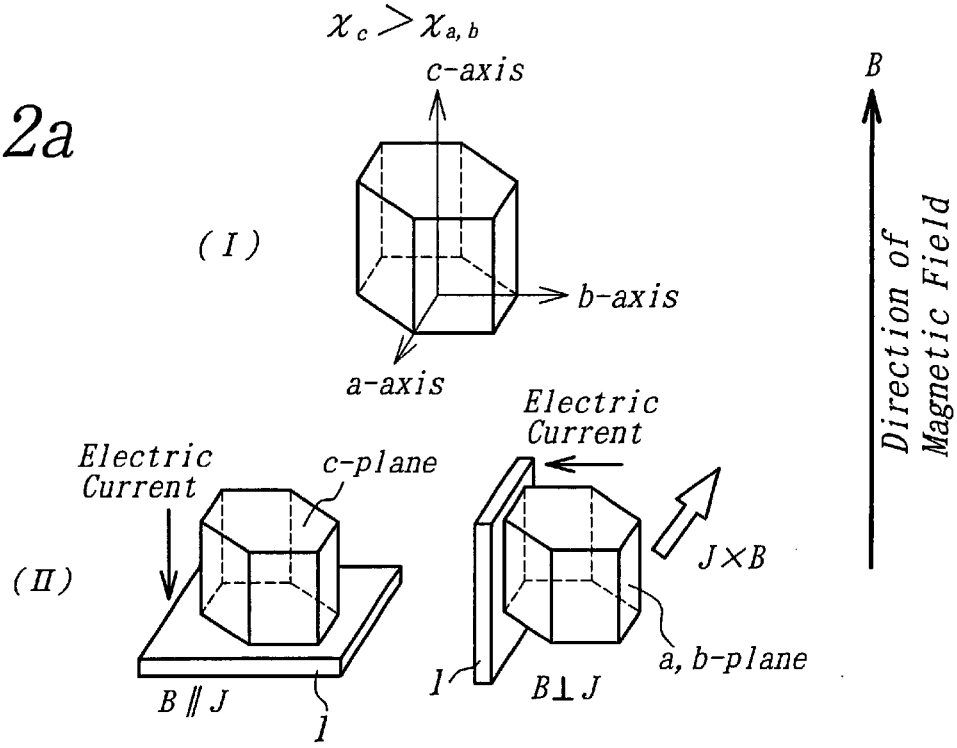
FIG. 2*a* and FIG. 2*b* are explanatory views showing the principle of controlling the orientation of metallic crystal by applying a magnetic field.
Figure 2B:
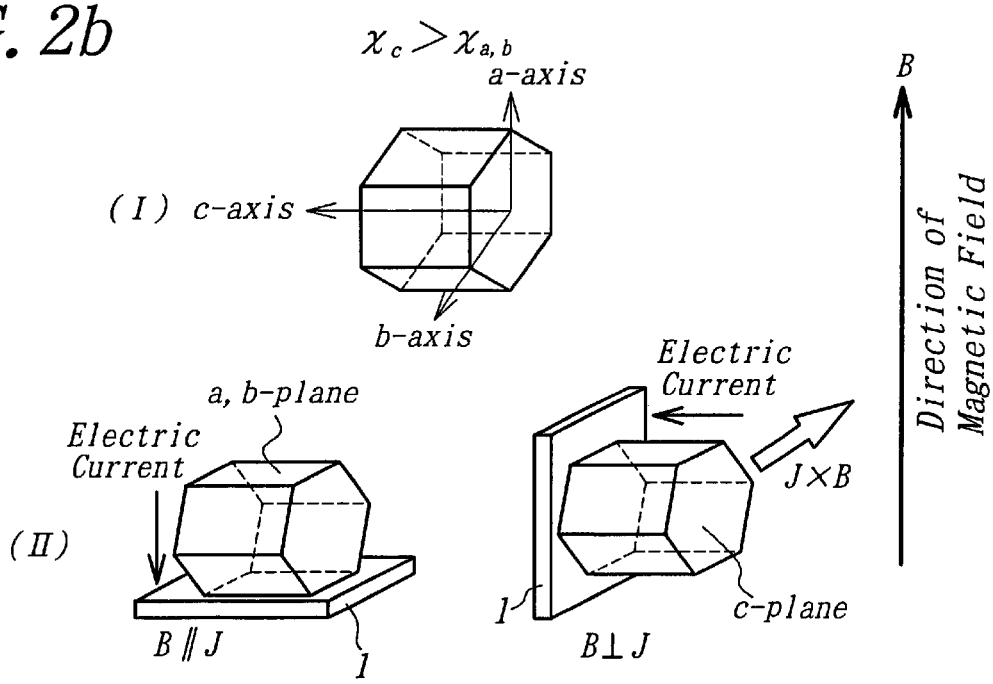

The principle of the invention will be explained below with reference to FIG. 2*a* and FIG. 2*b*. When a substance in an ionized state is crystallized on a substrate, the crystal orientation of the electro- or electroless-deposited film can be controlled by applying to the substrate a magnetic field in a predetermined direction. This is due to the fact that, as appreciated from FIG. 2*a* and FIG. 2*b*, previous to the electro- or electroless-deposition, the crystals are rotated by anisotropy of the magnetization energy as a result of anisotropy of magnetic susceptibility in the crystal axis. As indicated at (II) in both FIG. 2*a* and FIG. 2*b*, it is possible to develop an electro-deposited film having a desired crystal orientation, by changing the direction in which the magnetic field is applied.

For instance, Zn metal has a relative susceptibility $\chi$, i.e., the magnetic susceptibility per permeability in vacuum, which is $\chi_{a,b}=-1.81\times10^{-5}$ in directions along the a-axis and b-axis, and $\chi_c=-1.33\times10^{-5}$ in the direction along the c-axis. The relative susceptibility $\chi$ of Zn having a negative value means that Zn is a diamagnetic substance. As used herein, the sign $\chi$ indicates the relative susceptibility, and the subscripts a, b and c indicate the axial direction of the crystal.

When the magnetic field is applied upwards and in parallel with the surface of the substrate, the c-axis of Zn crystals are oriented in parallel with the direction of the magnetic field, i.e. parallel with the surface of the substrate since, as mentioned above, the values of $\chi_a$ and $\chi_b$ are smaller than that of $\chi_c$. Therefore, the crystals are rotated and attached to the substrate as shown in (II) of FIG. 2*a*, so as to minimize the magnetization energy. In other words, the crystals are oriented such that the direction of the crystal having higher magnetic susceptibility is in parallel with the direction of the applied magnetic field. According to the invention, based on such principle, it is possible to control the crystal orientation of Zn.

On the other hand, when the magnetic field is applied in parallel with the surface of the metal 2 as shown in FIG. 1*b*, it may become difficult to obtain a desired crystal orientation of the film, since the level of the overvoltage fluctuates due to the occurrence of flow of the electrolytic solution by Lorentz force. However, when a porous plate having a permeability to ion is arranged adjacent to the substrate, it is possible to advantageously suppress the flow of the electrolytic solution and to thereby positively obtain a thin film having a desired orientation.

The inventors carried out experiments wherein an ionized metal was subjected to electro-deposition on a copper substrate while applying a magnetic field, and X-ray diffraction analysis was conducted with respect to the electro-deposited film specimens thereby obtained. As a result, it has been confirmed that the crystal orientation of the electro-deposited metal films could be controlled in advantageous manner. The following examples even more clearly show the characteristic features of the invention.

EXAMPLE 1

The apparatus shown in FIG. 1*a* was used for the experiments. Zn was ionized in the apparatus in which a copper substrate 1 and a Zn plate 2 are immersed in the electrolytic solution within the casing 3. Subsequently, a Zn film having a thickness of about 20 $\mu$m was electro-deposited on the substrate 1 while applying a magnetic field of 7 T in a direction which is perpendicular to the surface of the substrate 1.

Figure 3A:
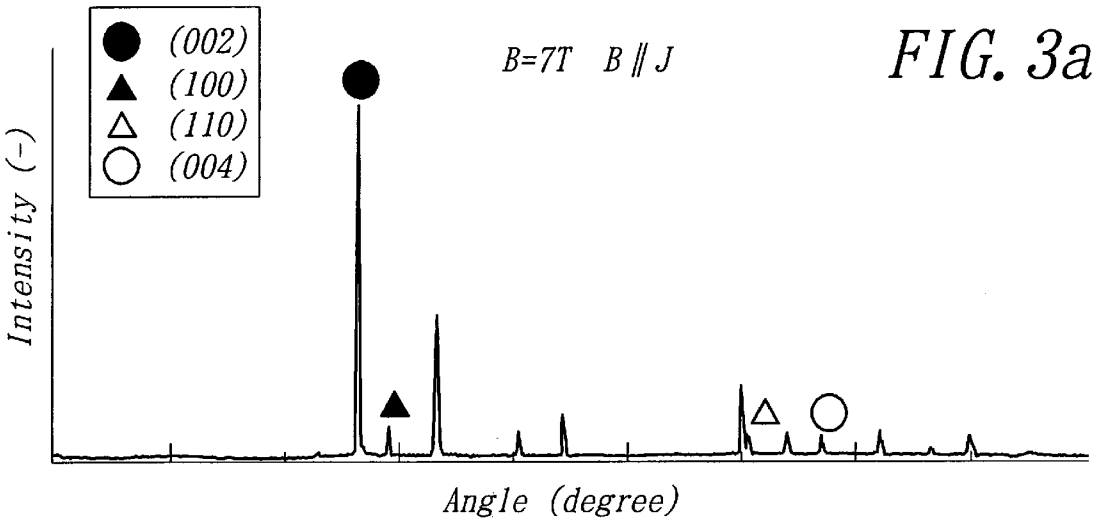
FIG. 3*a* is a chart showing the crystal orientation property of an electro-deposited Zn film obtained while applying a magnetic field in accordance with the invention.

With respect to the specimens of the electro-deposited Zn film, their crystal orientations were analyzed by an X-ray diffractmeter. The result of such analysis is shown in FIG. 3*a*. For the purpose of comparison, FIG. 3*b* shows the result of analysis for comparison, obtained with respect to the specimens obtained by an electro-deposition carried out under the same conditions except that the magnetic field was not applied.

Figure 3B:
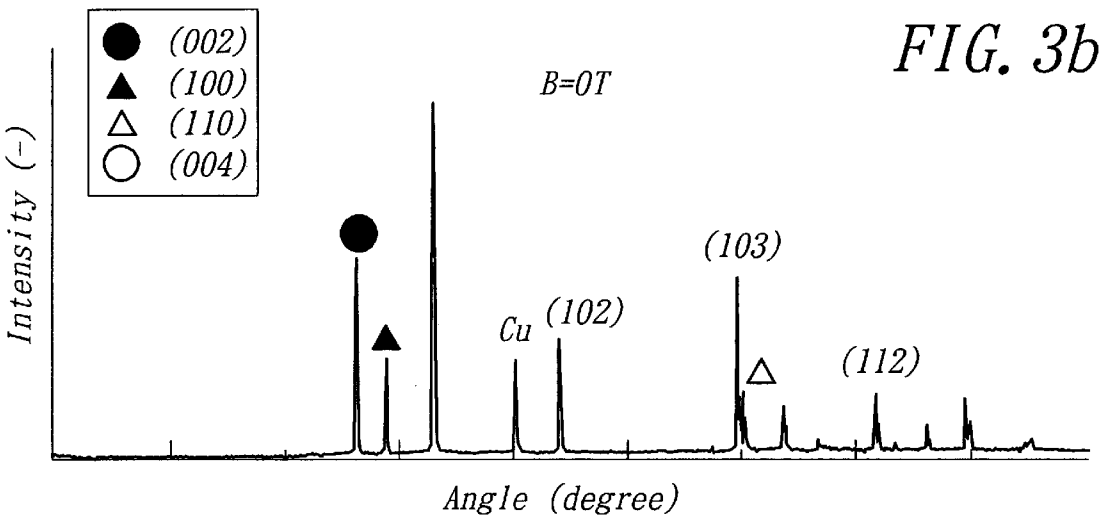
FIG. 3*b* is a similar chart showing the crystal orientation property of another electro-deposited Zn film obtained without applying a magnetic field.

It can be appreciated that, when the electro-deposition is carried out without applying a magnetic field, a sufficiently strong crystal orientation property cannot be observed in the electro-deposited film, as shown in FIG. 3*b*. On the other hand, when the electro-deposition is carried out while applying a magnetic field according to the invention, there can be recognized a significant increase in the intensity of the X-ray at the (002) plane, which is the c-plane, and also a significant decrease in the intensity at the (110) plane, which corresponds to the a- and b-planes, as shown in FIG. 3*a*. It can be thus understood that when an electro-deposition is carried out while applying a magnetic field according to the invention, the crystal orientation can be controlled such that the a- and b-planes are in parallel with the direction in which the magnetic field is applied, and the c-plane is in parallel with the surface of substrate.

EXAMPLE 2

Figure 4:
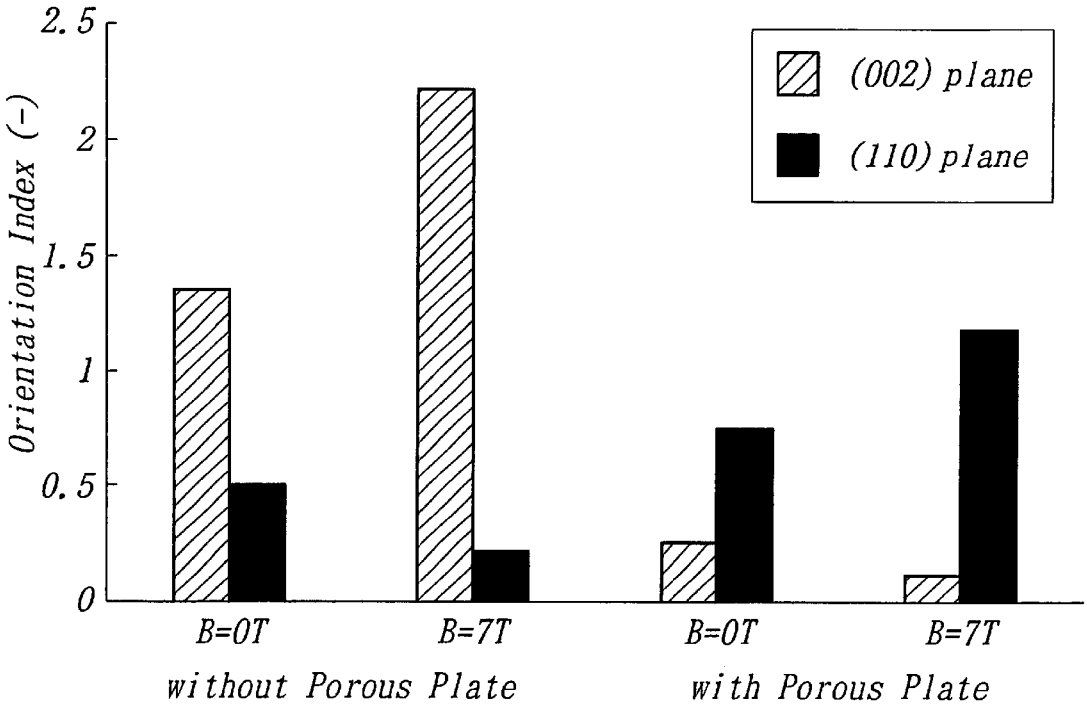
FIG. 4 is a graph showing a difference in the crystal orientation property of electro-deposited Zn films depending upon whether or not a magnetic field is applied, and whether or not a flow-suppression porous plate is arranged.

The apparatus shown in FIG. 1*b* was used for the experiments, in which Zn was ionized as in Example 1. Subsequently, a Zn film having a thickness of about 20 $\mu$m was electro-deposited on the substrate 1 while applying a magnetic field of 7 T in a direction which is in parallel with the surface of the substrate 1. The electro-deposition was carried out under the presence of a flow-suppression porous plate, and also carried out without using the porous plate. With respect to the specimens of the electro-deposited Zn film, their crystal orientations were analyzed by an X-ray diffractmeter. The result of the analysis is shown in FIG. 4 which also shows the result of comparative analysis for specimens of which the electro-deposition was carried out under the same conditions except that the magnetic field was not applied.

It can be appreciated that, when the electro-deposition is carried out without a flow-suppression porous plate in the electro-deposition environment, the orientation index at the (002) plane is increased by application of the magnetic field. This means that the c-plane orientation is enhanced with the c-plane of the crystals oriented in parallel with the applied magnetic field. On the other hand, when the electro-deposition is carried out with the flow-suppression porous plate arranged in the electro-deposition environment, the orientation index of (110) plane is increased by application of the magnetic field. This means that the a-plane and b-plane orientations are enhanced with the a- and b-planes of the crystals oriented in parallel with the applied magnetic field. In this way, the orientation of crystals can be effectively controlled to the direction in which the magnetization energy is minimized due to suppression of the flow of the electrolytic solution by the porous plate adjacent to the substrate.

While the present invention has been described with reference to some specific embodiments illustrated in the drawings, it is of course that various changes or modifications may be made without departing from the scope of the invention as defined by the appended claims.

For instance, when a metal having different corrosion resistance or abrasion resistance according to its crystal direction is subjected to an electroor electroless-deposition, it is possible to orient the metal crystals into a selected plane exhibiting excellent corrosion resistance or abrasion resistance, or into a direction which is in parallel with the surface of the metal film on a substrate surface. Moreover, when the present invention is applied to a thermoelectric material, it is possible to produce a material having a crystal orientation that realizes an improved conversion efficiency between thermal energy and electrical energy.

As above-mentioned, according to the invention, the crystal orientation of an electro- or electroless-deposited film can be effectively controlled to the desired direction due to the application of a magnetic field to a substance in its electrolytic state, for example, metal ion of various substances. Therefore, according to the invention, it is possible not only to selectively develop a metal plane, which has an excellent resistance to corrosion or abrasion, but also to produce a thermoelectric material having an excellent energy conversion efficiency.

The invention can be widely applied even to non-magnetic materials in contrast to the prior art wherein the material capable of controlling the crystal orientation of the electro-or electroless-deposited film has been limited to a ferromagnetic body, such as cobalt-based alloy for magnetic materials.

What is claimed is:

1. A method of producing an electro- or electroless-deposited film with a controlled crystal orientation, comprising the steps of:

depositing on a substrate a material in its electrolytic-state by one of an electro-deposition process and an electroless-deposition process;

selecting an arranging position of the substrate and an applying direction of a magnetic field to the electro-deposition or electroless-deposition environment in accordance with a desired crystal orientation in the deposited film; and applying the magnetic field during deposition;

wherein a porous plate is provided adjacent to said substrate so as to suppress a flow of an electrolytic solution which occurs during the application of said magnetic field.

2. The method according to claim 1, wherein said material is a paramagnetic material.

3. The method according to claim 2, wherein said magnetic field has an intensity at least on the order of 7 T.

4. The method according to claim 1, wherein said material is a diamagnetic material.

5. The method according to claim 4, wherein said magnetic field has an intensity at least on the order of 7 T.

* * * * *